US005744908A

United States Patent [19]

Kyushima

[11] Patent Number: 5,744,908

[45] Date of Patent: Apr. 28, 1998

[54] ELECTRON TUBE

[75] Inventor: Hiroyuki Kyushima, Hamamatsu, Japan

[73] Assignee: Hamamatsu Photonics K.K., Hamamatsu, Japan

[21] Appl. No.: 813,312

[22] Filed: Mar. 10, 1997

Related U.S. Application Data

[63] Continuation of Ser. No. 398,153, Mar. 3, 1995, abandoned.

[30] Foreign Application Priority Data

Jun. 28, 1994 [JP] Japan ..... 6-146639

[51] Int. Cl.[6] ..... H01J 43/00

[52] U.S. Cl. ..... 313/533; 313/532; 313/103 R; 313/105 CM

[58] Field of Search ..... 313/532, 533, 313/103 R, 103 CM, 104, 105 R, 105 CM

[56] References Cited

U.S. PATENT DOCUMENTS

| | | | |
|---|---|---|---|
| 3,939,374 | 2/1976 | Schagen et al. . | |
| 4,649,314 | 3/1987 | Eschard . | |
| 4,825,118 | 4/1989 | Kyushima . | |
| 5,510,674 | 4/1996 | Kyushima et al. | 313/533 |

FOREIGN PATENT DOCUMENTS

| | | |
|---|---|---|
| 0 154 688 | 9/1985 | European Pat. Off. . |
| 0 551 767 | 7/1993 | European Pat. Off. . |
| 60-39752 | 3/1985 | Japan . |
| 5-182631 | 7/1993 | Japan . |

*Primary Examiner*—Sandra L. O'Shea
*Assistant Examiner*—Vip Patel
*Attorney, Agent, or Firm*—Cushman Darby & Cushman IP Group of Pillsbury Madison & Sutro LLP

[57] ABSTRACT

An electron tube includes an electron multiplication unit for multiplying an incident electron flow by secondary electron emission. This electron multiplication unit is formed by stacking a plurality of dynodes toward an incident side of the electron flow. A plurality of through holes are arranged and formed in each dynode, in which one end on the incident side of the electron flow is used as an input opening, and the other end is used as an output opening. An acceleration electrode unit projecting toward the through hole of the upper dynode is provided at an edge portion of the input opening. As described above, the acceleration electrode unit is provided at the edge portion of the input opening of the through hole formed in each dynode. For this reason, a damping electric field is pushed up by the acceleration electrode unit and deeply warped into the through hole of the upper dynode. With the action of the damping electric field, the secondary electrons are properly guided to the next dynode, thereby improving the electron collection efficiency.

10 Claims, 8 Drawing Sheets nth

ELECTRON TUBE

This is a continuation of application No. 08/398,153, filed on Mar. 3, 1995, which was abandoned upon the filing hereof.

BACKGROUND OF THE INVENTION

1. Field of the Invention

The present invention relates to an electron tube having an electron multiplication unit for multiplying an incident electron flow by secondary electron emission.

2. Related Background Art

Conventionally, a technique disclosed in Japanese Patent Laid-Open No. 5-182631 is known as a technique of such a field. FIG. 8 shows the sectional structure of the dynodes of the conventional electron tube described in this prior art. In FIG. 8, a plurality of dynodes are stacked in an electrically insulated state, but only the nth and (n+1)th dynodes are shown.

A dynode 100 has a plate 102 in which a plurality of through holes 101 are formed. The arrangement position of the plate 102 is inverted for each stage such that the inclination of the through holes 101 is inverted for each stage. As for the through holes 101, an output opening 104 has a diameter larger than that of an input opening 103. A predetermined voltage is applied to the plate 102 of each stage by a power supply 105 such that the potentials of the dynodes 100 are sequentially increased. In this example, a voltage value $V_1$ applied to the nth dynode 100 is 100 V. A voltage value $V_2$ applied to the (n+1)th dynode 100 is 200 V. Since each through hole 101 of the plate 102 has a conductive surface, the upper and lower surface of the plate 102 is charged at the same potential by the voltage applied from the power supply 105.

With this structure, electrons incident on each through hole 101 of the nth dynode 100 collide against an inclined portion 106, thereby emitting secondary electrons from a secondary electron emission layer formed on the inclined portion 106. The emitted secondary electrons are guided to a damping electric field formed by a potential difference between the nth dynode 100 and the (n+1)th dynode 100, incident on the through holes 101 of the (n+1)th dynode 100, and similarly amplified.

The distribution state of the potentials between the nth dynode 100 and the (n+1)th dynode 100 is indicated by a dotted line in FIG. 8. Equipotential lines of 120 V, 150 V, and 180 V are represented by A, B, and C, respectively. The equipotential line B is present at an intermediate position between the nth dynode 100 and the (n+1)th dynode 100. The equipotential lines A and C are warped into the through holes 101 of the nth dynode 100 and the (n+1)th dynode 100, respectively. As described above, each of the through holes 101 has the output opening 104 with a diameter larger than that of the input opening 103. For this reason, the equipotential line A is deeply warped into the through holes 101 as compared to the equipotential line C.

As described above, when the equipotential line A is deeply warped into the through holes 101, the damping electric field in the through holes 101 is strengthened to easily guide secondary electrons 107 emitted from the lower portion of the inclined portion 106 of the nth dynode 100 to the (n+1)th dynode 100.

Japanese Patent Laid-Open Nos. 2-291654 and 2-291655 also disclose conventional electron tubes.

SUMMARY OF THE INVENTION

An electron tube of the present invention has a first dynode and a second dynode which are positioned adjacent to each other, the dynodes being plates formed with through holes, the through holes having an incident opening to receive incident electrons and an emission opening for emitting multiplied electrons. The first and second dynodes are positioned such that the emission opening of the first dynode faces the incident opening of the second dynode. The second dynode has a protruding acceleration electrode unit, located close to the incident opening of the second dynode on the surface facing the first dynodes, and protrudes towards the emission opening of the first dynode.

As described above, the acceleration electrode unit is located close to the incident opening of the through hole formed in the second dynode. For this reason, a damping electric field is pushed up by the acceleration electrode unit and deeply warped into the through hole of the first dynode. With the action of the damping electric field, the electrons are properly guided from the first dynode to the second dynode, thereby improving the electron collection efficiency.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

DESCRIPTION OF THE PREFERRED EMBODIMENTS

An embodiment of the present invention will be described below with reference to the accommodating drawings. FIG.

Figure 1:
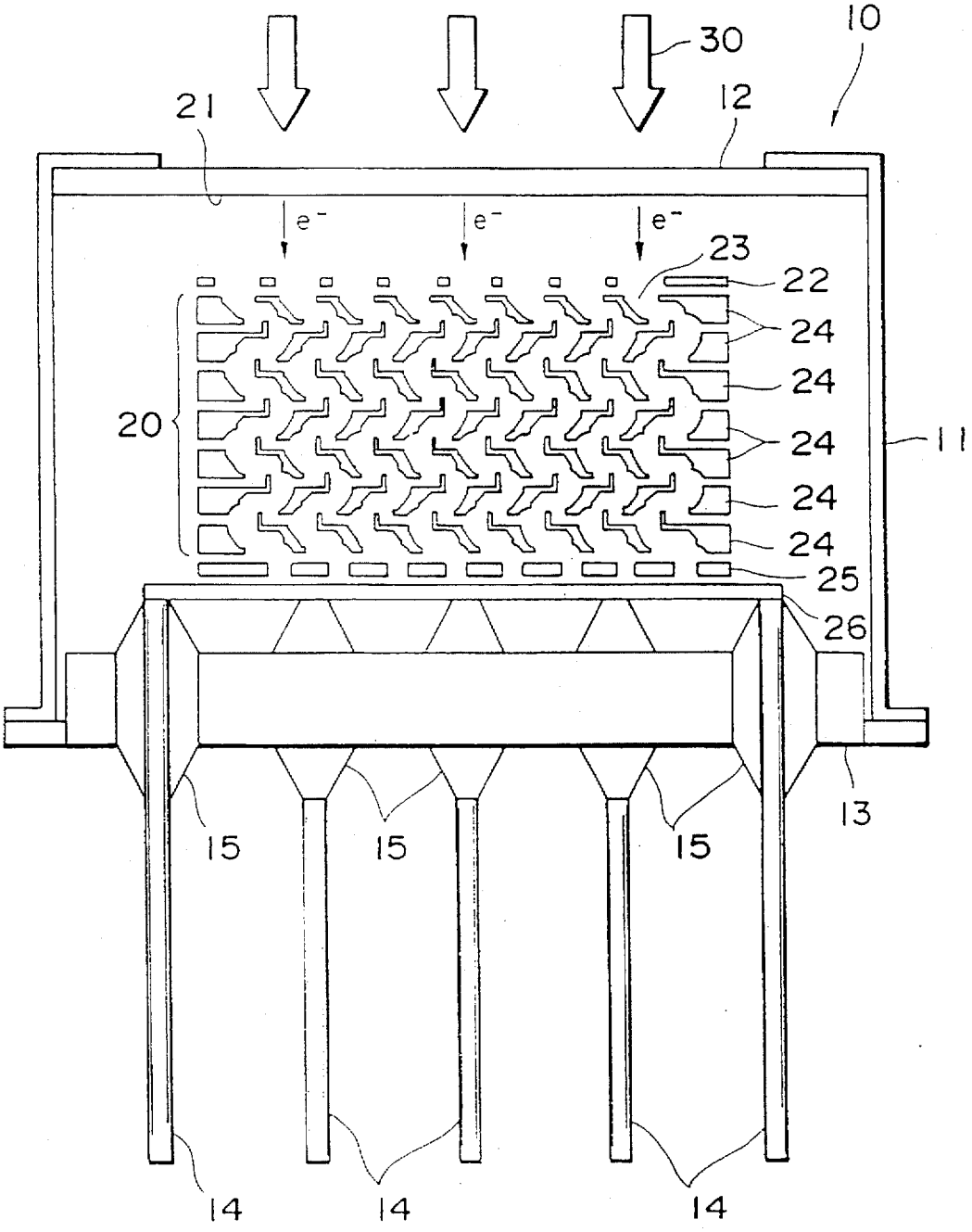
FIG. 1 is a sectional side view showing the structure of an electron tube according to one embodiment of this invention.
Figure 2:
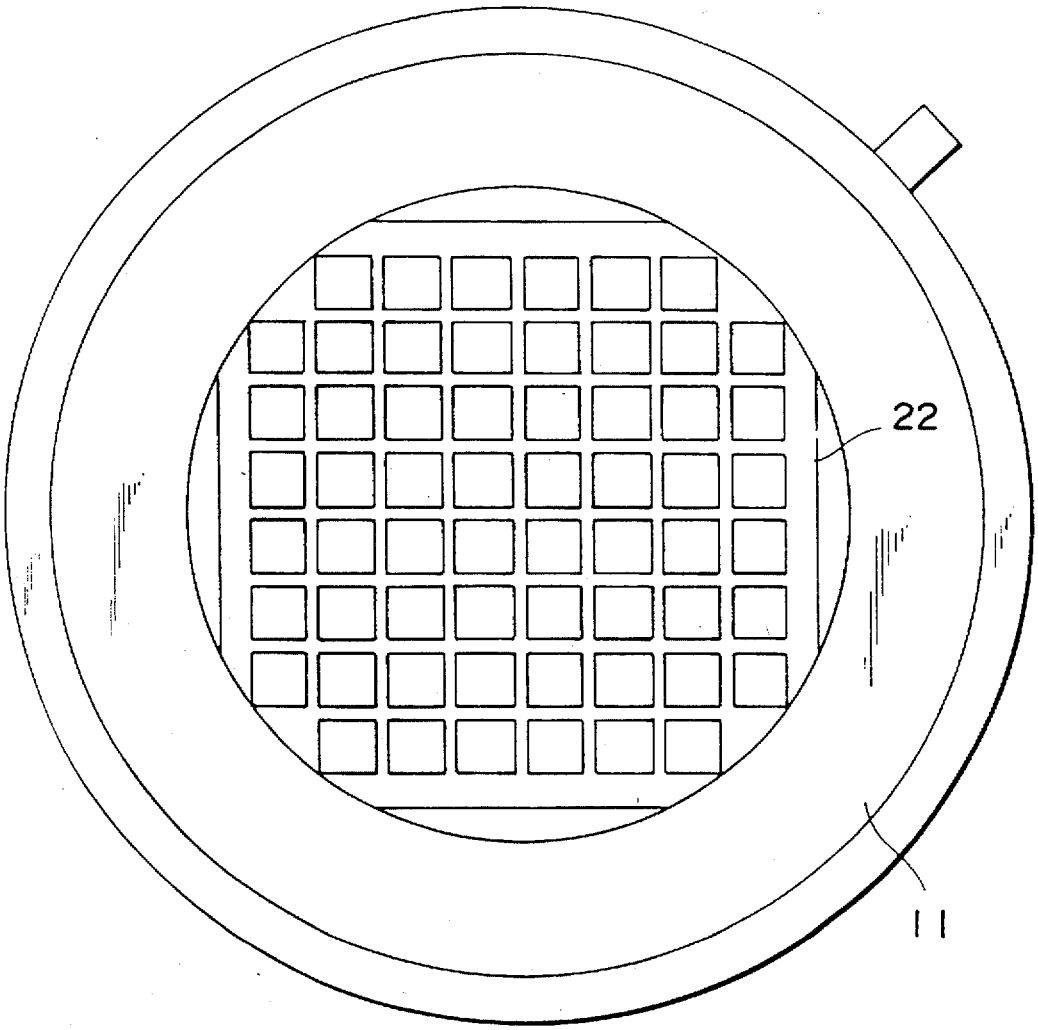
FIG. 2 is a plan view showing the structure of the electron tube according to the embodiment of FIG. 1.

1 is a sectional side view showing the structure of an electron tube according to this embodiment. FIG. 2 is a plan view showing the structure of the electron tube according to this embodiment. Referring to FIGS. 1 and 2, in the electron tube of this embodiment, an electron multiplication unit 20 for multiplying an incident electron flow is arranged in a column-like vacuum vessel 10. The vacuum vessel 10 is formed by a cylindrical metal side tube 11, a circular light-receiving surface plate 12 provided to one end of the metal side tube 11, and a circular stem 13 provided to the other end of the metal side tube 11. A photocathode 21 is arranged on the lower surface of the light-receiving surface plate 12. A focusing electrode 22 is arranged between the photocathode 21 and the electron multiplication unit 20.

The electron multiplication unit 20 is formed by stacking dynodes 24 each having a large number of electron multiplication holes 23. An anode 25 and a last-stage dynode 26 are sequentially arranged below the dynodes 24.

The stem 13 serving as a base portion is connected to external voltage terminals. Twelve stem pins 14 for applying a predetermined voltage to the dynodes 24 and 26 and the like extend through the stem 13. Each stem pin 14 is fixed to the stem 13 by a tapered hermetic glass 15. Each stem pin 14 has a length to reach a to-be-connected dynode 24 or 26. The distal end of the stem pin 14 is connected to the connecting terminal (not shown) of the corresponding dynode 24 or 26 by resistance welding.

The materials of the above-described members are as follows. As the material of the metal side tube 11, the stem 13, and the stem pins 14, Kovar metal, SUS (stainless steel), aluminum, or iron-nickel is used. As the material of the light-receiving surface plate 12, Kovar glass, UV glass, quartz, $MgF_2$, or sapphire is used. As the material of the photocathode 21, bialkali, multialkali, GaAs, or CsTe is used. As the material of the focusing electrode 22, SUS (stainless steel) or tungsten is used. As the material of the dynodes 24 and 26, and the anode 25, SUS (stainless steel), aluminum, nickel, or CuBe is used.

Light 30 incident on the light-receiving surface plate 12 excites electrons in the photocathode 21 on the lower surface to emit photoelectrons in the vacuum. The photoelectrons emitted from the photocathode 21 are focused on the uppermost dynode 24 by the matrix-like focusing electrode 22 (FIG. 2), and secondary multiplication is performed. Secondary electrons emitted from the uppermost dynode 24 are applied to the lower dynodes 24 to repeat secondary electron emission. A secondary electron group emitted from the last-stage dynode 24 is extracted from the anode 25. The extracted secondary electron group is externally output through the stem pins 14 connected to the anode 25.

Figure 3:
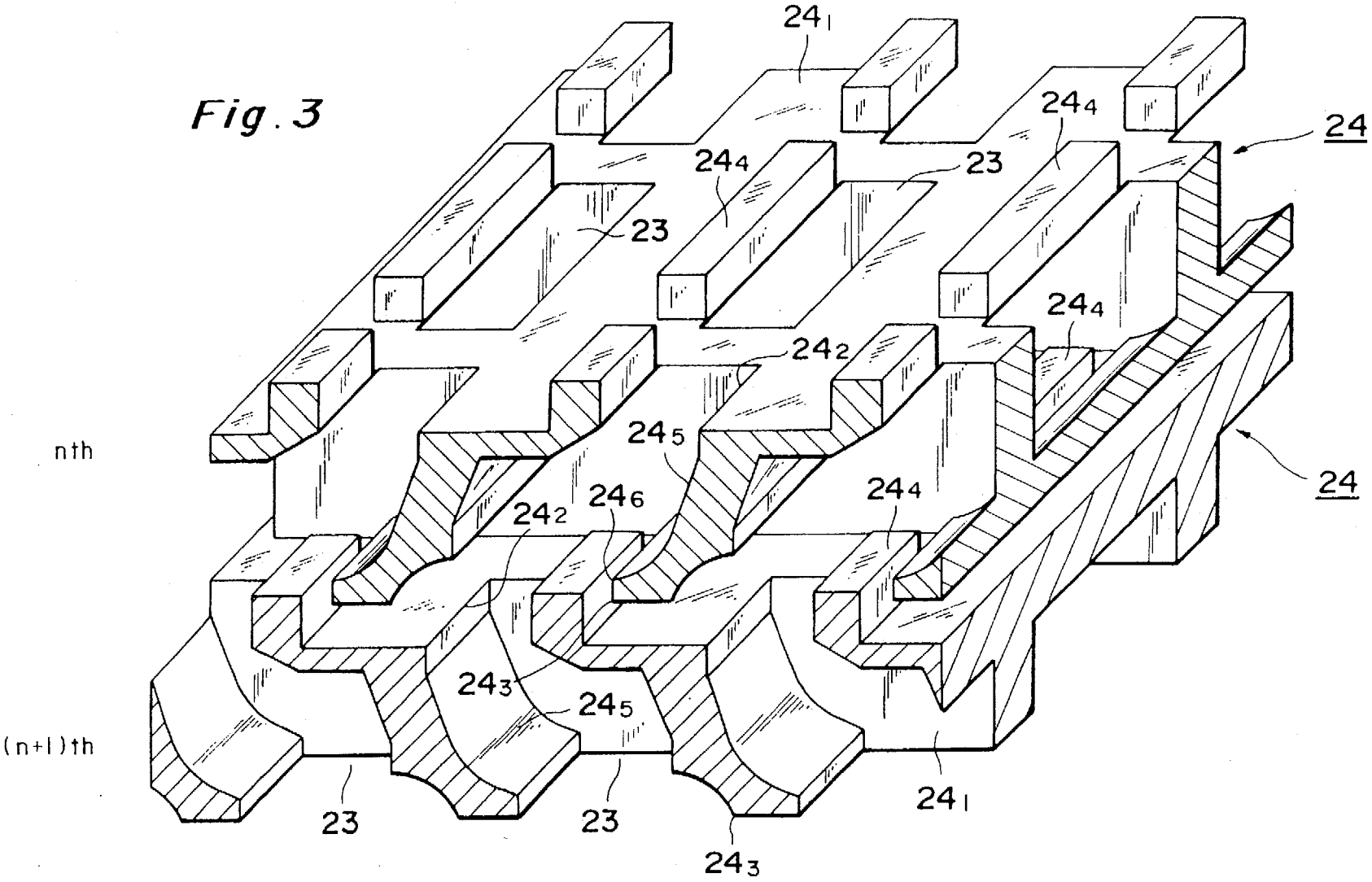
FIG. 3 is a sectional view showing two continuous dynodes out of a plurality of dynodes constituting which form an electron multiplication unit.

The structure of the dynodes 24 as a characteristic feature of this embodiment will be described below with reference to the perspective view in FIG. 3. FIG. 3 shows the structure of the continuous nth and (n+1)th dynodes 24 of the plurality of dynodes 24 stacked in an electrically insulated state. The dynode 24 has a plate $24_1$, whose surface has conductivity. A plurality of electron multiplication holes 23 are regularly arranged and formed in the plate $24_1$. Rectangular input openings $24_2$ each serving as one end of the electron multiplication hole 23 are formed in the upper surface of the plate $24_1$. Substantially square output openings $24_3$, each serving as the other end of the electron multiplication hole 23 are formed in the lower surface. A parallelepiped acceleration electrode unit $24_4$ is provided to the edge portion of the input opening $24_2$ of each electrode multiplication hole 23.

The electron multiplication hole 23 is inclined with respect to the incident direction of electrons which are incident through the input opening $24_2$. A secondary electron radiation layer $24_5$ is formed on an inclined portion of the inner wall of each electron multiplication hole 23, where the electrons incident through the input opening $24_2$ collide. The secondary electron radiation layer $24_5$ is formed by vacuum-depositing an antimony (Sb) layer in the region of the secondary electron radiation layer $24_5$ of the plate $24_1$, and causing this layer to react with alkali. In addition to this forming method, if CuBe is used as the material of the plate $24_1$, the region of the secondary electron radiation layer $24_5$ of the plate $24_1$ can be activated and formed in oxygen.

The nth dynode 24 and the (n+1)th dynode 24 are stacked while the arrangement position of the plate $24_1$ is inverted such that the inclination of the electron multiplication holes 23 is inverted for each stage. In addition, the acceleration electrode units $24_4$ of the (n+1)th dynode 24 enter the electron multiplication holes 23 of the nth dynode 24. Since one long side of the acceleration electrode unit $24_4$ is shorter than one side of the output opening $24_3$, the acceleration electrode unit $24_4$ of the (n+1)th dynode 24 does not contact the output opening $24_3$ of the nth dynode 24. As described above, when the acceleration electrode units $24_4$ enter the electron multiplication holes 23, a damping electric field for guiding the secondary electrons can be deeply warped into the electron multiplication holes 23.

In this embodiment, the interval between the acceleration electrode unit $24_4$ and the output opening $24_3$ is 80 μm. This interval depends on the potential difference between the nth dynode 24 and the (n+1)th dynode 24. The minimum value of the interval is 20 μm, and the maximum value is 160 μm. The acceleration electrode units $24_4$ do not necessarily enter the electron multiplication holes 23 of the upper stage. When the acceleration electrode units $24_4$ only slightly project upward from the upper surface of the plate $24_1$, an effect for pushing up the damping electric field can be sufficiently obtained. However, to obtain a larger effect, it is preferable that the acceleration electrode units $24_4$ enter the electron multiplication holes 23 of the upper stage. The acceleration electrode units $24_4$ can enter the electron multiplication holes 23 of the upper stage to the position of a lower end $24_6$ of the secondary electron radiation layer $24_5$ (the upper end of the vertical surface of the output opening $24_3$) at maximum.

Figure 4:
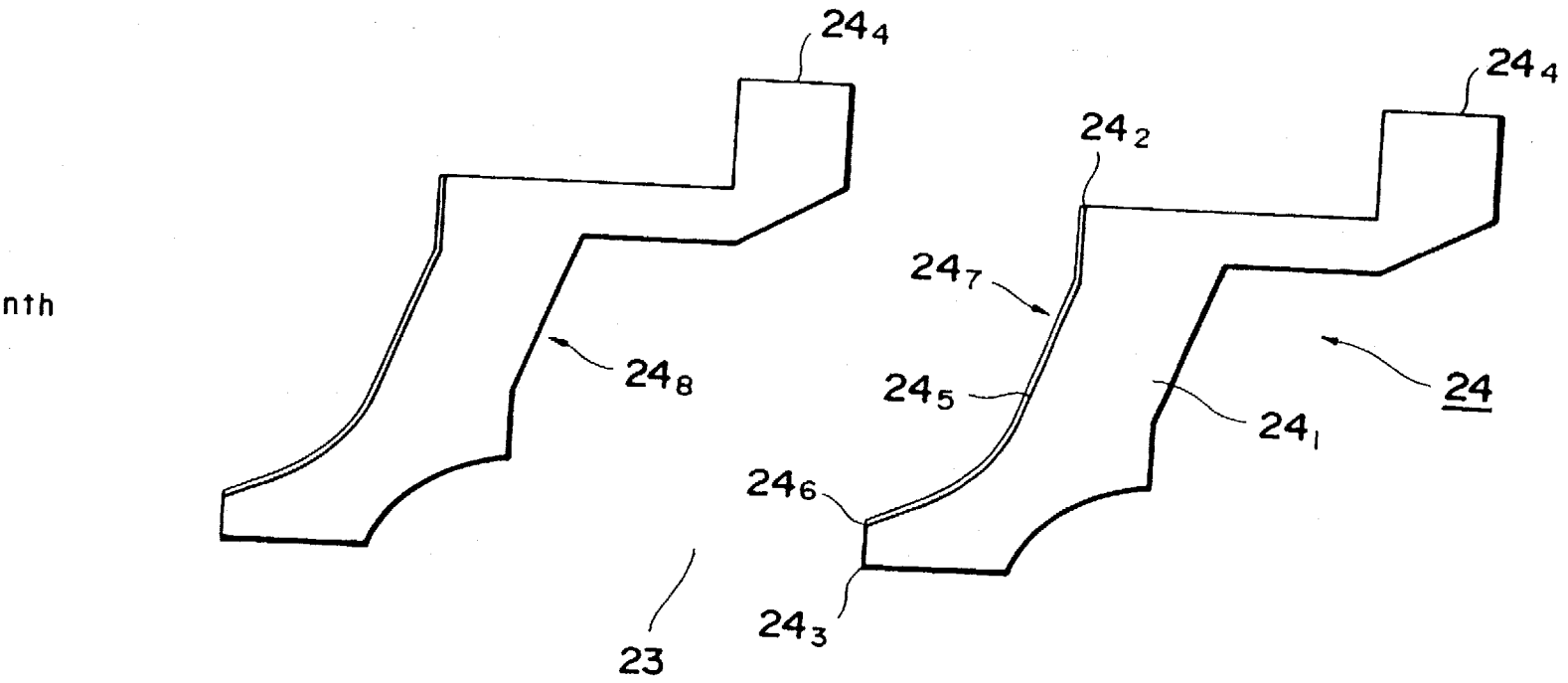
FIG. 4 is a partial sectional view showing the shape of an electron multiplication hole formed in the dynode.

FIG. 4 is a partial sectional view showing the shape of the electron multiplication hole 23 formed in the nth dynode 24, which sectional view is obtained upon taking along a direction perpendicular to the longitudinal direction of the acceleration electrode unit $24_4$. The electron multiplication hole 23 taken along the longitudinal direction of the acceleration electrode unit $24_4$ has a rectangle section. The electron multiplication hole 23 of the (n+1)th dynode 24 also has the same shape except that the direction is different.

The electron multiplication hole 23 has a substantially tapered shape extending toward the output opening $24_3$ such that the diameter of the output opening $24_3$ in the sectional direction is about twice that of the input opening $24_2$ in the sectional direction. The central axis of the electron multiplication hole 23 is inclined to the right side of FIG. 4 by about 50° with respect to the upper surface of the plate $24_1$. Of the inner wall of the electron multiplication hole 23, an inner wall $24_7$ (a surface on which the secondary electron radiation layer $24_5$ is formed) facing the input opening $24_2$ is inclined to the right side of FIG. 4 by about 60° with respect to the upper surface of the plate $24_1$. An inner wall $24_8$ (a surface opposing the inner wall $24_7$) facing the output opening $24_3$ is inclined to the right side of FIG. 4 by about 40° with respect to the upper surface of the plate $24_1$.

The inner wall $24_7$ can be divided into four portions in a direction perpendicular to the upper surface of the plate $24_1$. A portion corresponding to about 2/9 from the end portion of the input opening $24_2$ is a plane perpendicular to the upper surface of the plate $24_1$. A portion corresponding to about 4/9 from that portion is a plane having an angle of about 70° with respect to the upper surface of the plate $24_1$. A portion corresponding to about 1/9 from the end portion of the output opening $24_3$ is a plane perpendicular to the upper surface of the plate $24_1$. A portion corresponding to about 2/9 from that portion is a recessed curved surface having an angle of about 30° with respect to the upper surface of the plate $24_1$.

Similarly, the inner wall $24_8$ can be divided into four portions in a direction perpendicular to the upper surface of the plate $24_1$. A portion corresponding to about 1/7 from the end portion of the input opening $24_2$ is a plane having an angle of about 30° with respect to the upper surface of the plate $24_1$. A portion corresponding to about 3/7 from that portion is a plane having an angle of about 70° with respect to the upper surface of the plate $24_1$. A portion corresponding to about 2/7 from the end portion of the output opening $24_3$ is a recessed curved surface having an angle of about 35° with respect to the upper surface of the plate $24_1$. A portion corresponding to about 1/7 from that portion is a plane perpendicular to the upper surface of the plate $24_1$. Additionally, a plane parallel to the upper surface of the plate $24_1$ is present on the inner wall $24_8$ at a position separated from the upper end by about 1/7 the total distance. The length of the plate in the sectional direction is about 5/8 the diameter of the input opening $24_2$ in the sectional direction.

The input openings $24_2$ are formed in the upper surface of the plate $24_1$ at an equal interval. The interval between the adjacent input openings $24_2$ in the sectional direction of the plane is about twice the diameter of the input opening $24_2$ in the sectional direction. On the plane between the adjacent input openings $24_2$, the parallelepiped acceleration electrode unit $24_4$ is formed at the end portion of the input opening $24_2$ on the inner wall $24_8$ side. The length of the acceleration electrode unit $24_4$ in the sectional direction is about 2/7 the interval between of the adjacent input openings $24_2$ in the sectional direction of the plane.

Figure 5:
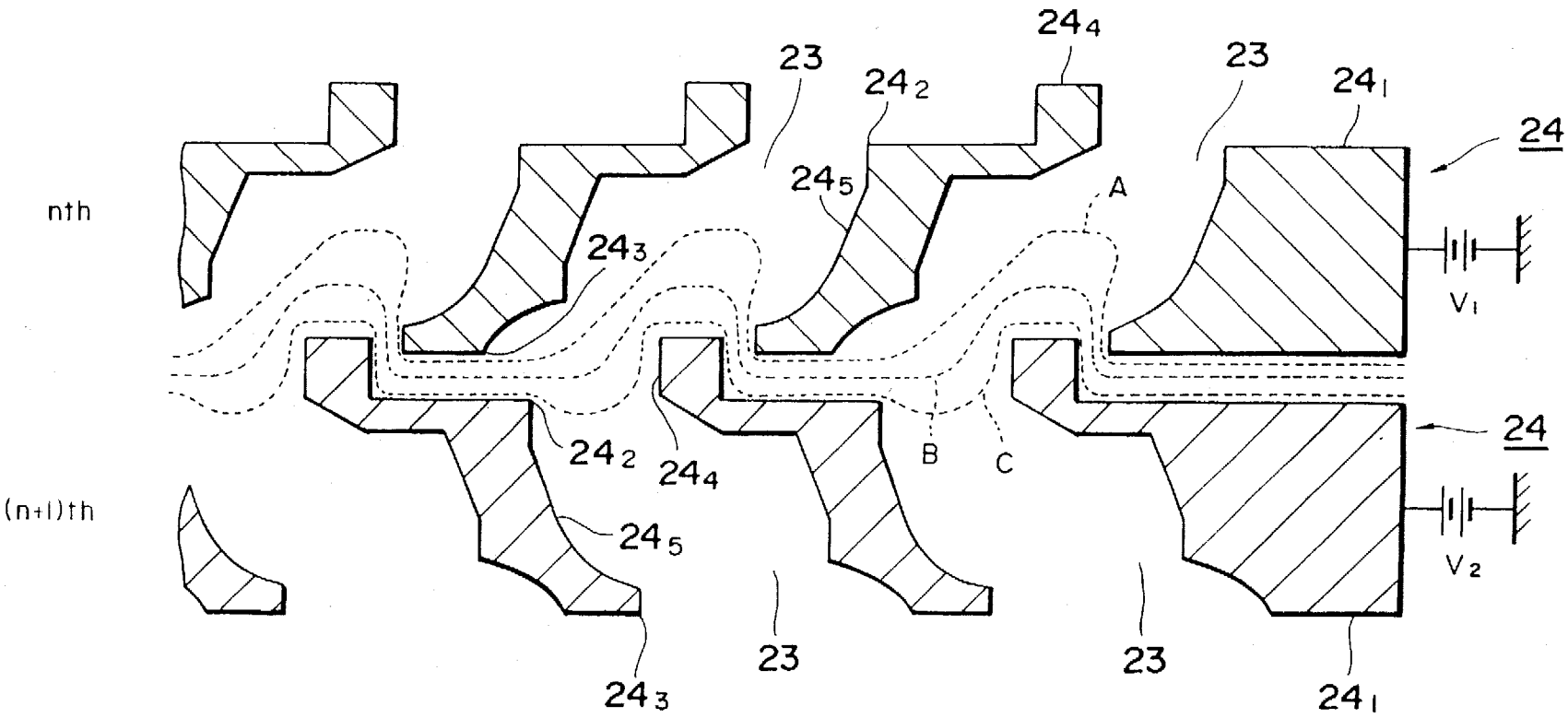
FIG. 5 is a view showing the distribution state of the potentials of the two continuous dynodes.
Figure 8:
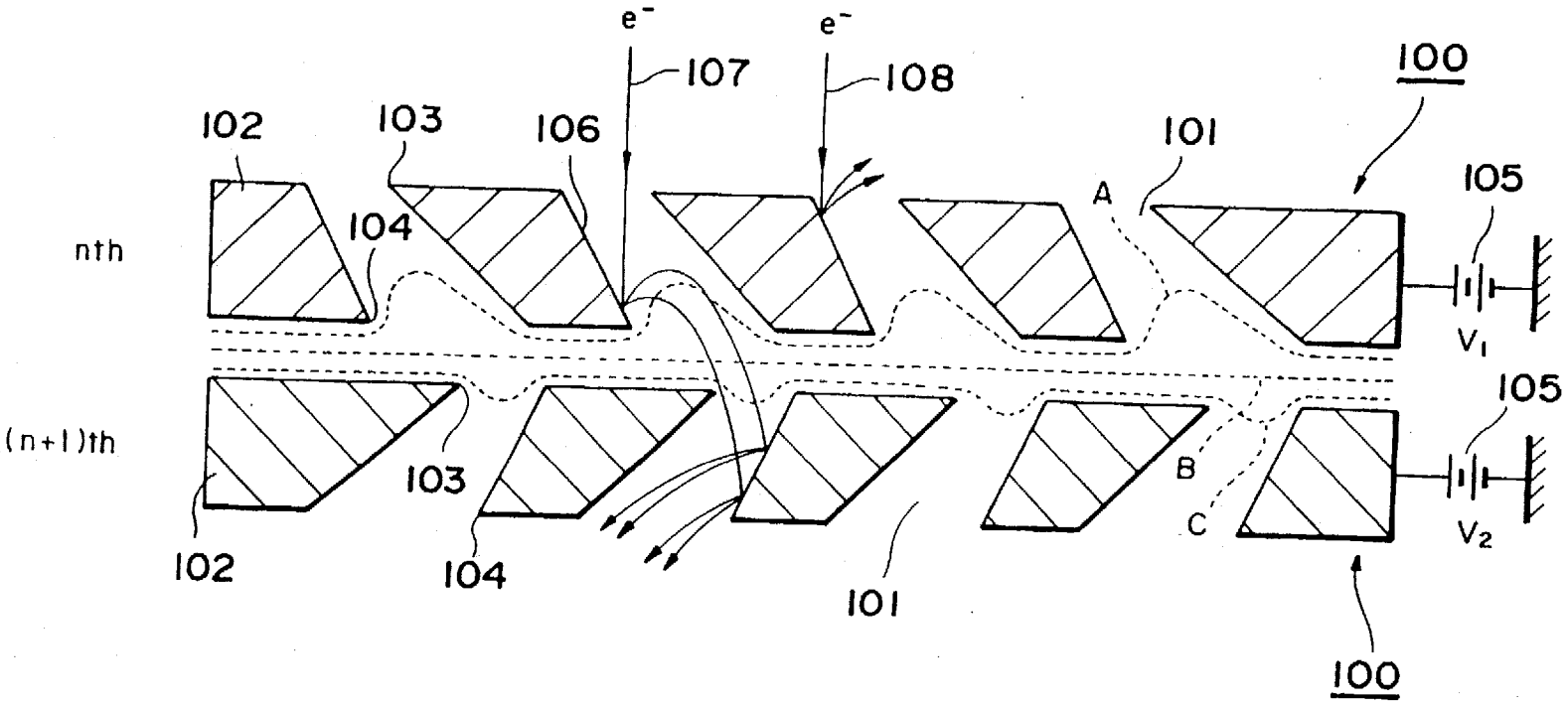
Fig. 8 PRIOR ART
FIG. 8 is a sectional view showing two dynode plates of a conventional electron multiplication unit.

FIG. 5 is a view showing the distribution state of the potentials of the nth dynode 24 and the (n+1)th dynode 24. A voltage value $V_1$ applied to the nth dynode 24 is 100 V, and a voltage value $V_2$ applied to the (n+1)th dynode 24 is 200 V. As in the above-described prior art (FIG. 8), equipotential lines of 120 V, 150 V, and 180 V are represented by A, B, and C, respectively.

In this case, only the equipotential line C is warped into the electron multiplication holes 23 of the (n+1)th dynode 24 through the input openings $24_2$. The equipotential lines A, B, and C are pushed up by the acceleration electrode units $24_4$ of the (n+1)th dynode 24, which project into the electron multiplication holes 23 of the nth dynode 24, so that the equipotential lines A, B, and C are warped into the electron multiplication holes 23 of the nth dynode 24 through the output openings $24_2$. Particularly, the equipotential line A is formed to be deeply warped into the electron multiplication holes 23 of the nth dynode 24.

Therefore, if the area of the output opening $24_3$ is not changed, the equipotential line, i.e., the damping electric field for guiding the secondary electrons can be deeply warped into the electron multiplication holes 23 as compared to the prior art (FIG. 8) which has no acceleration electrode unit $24_4$. For this reason, the damping electric field in the electron multiplication holes 23 is strengthened, so that the secondary electrons emitted from the upper stage of the secondary electron radiation layer $24_5$, which cannot be guided to the lower dynode 24 in the prior art, can be properly guided to the lower dynode 24, thereby improving the electron collection efficiency.

Figure 6:
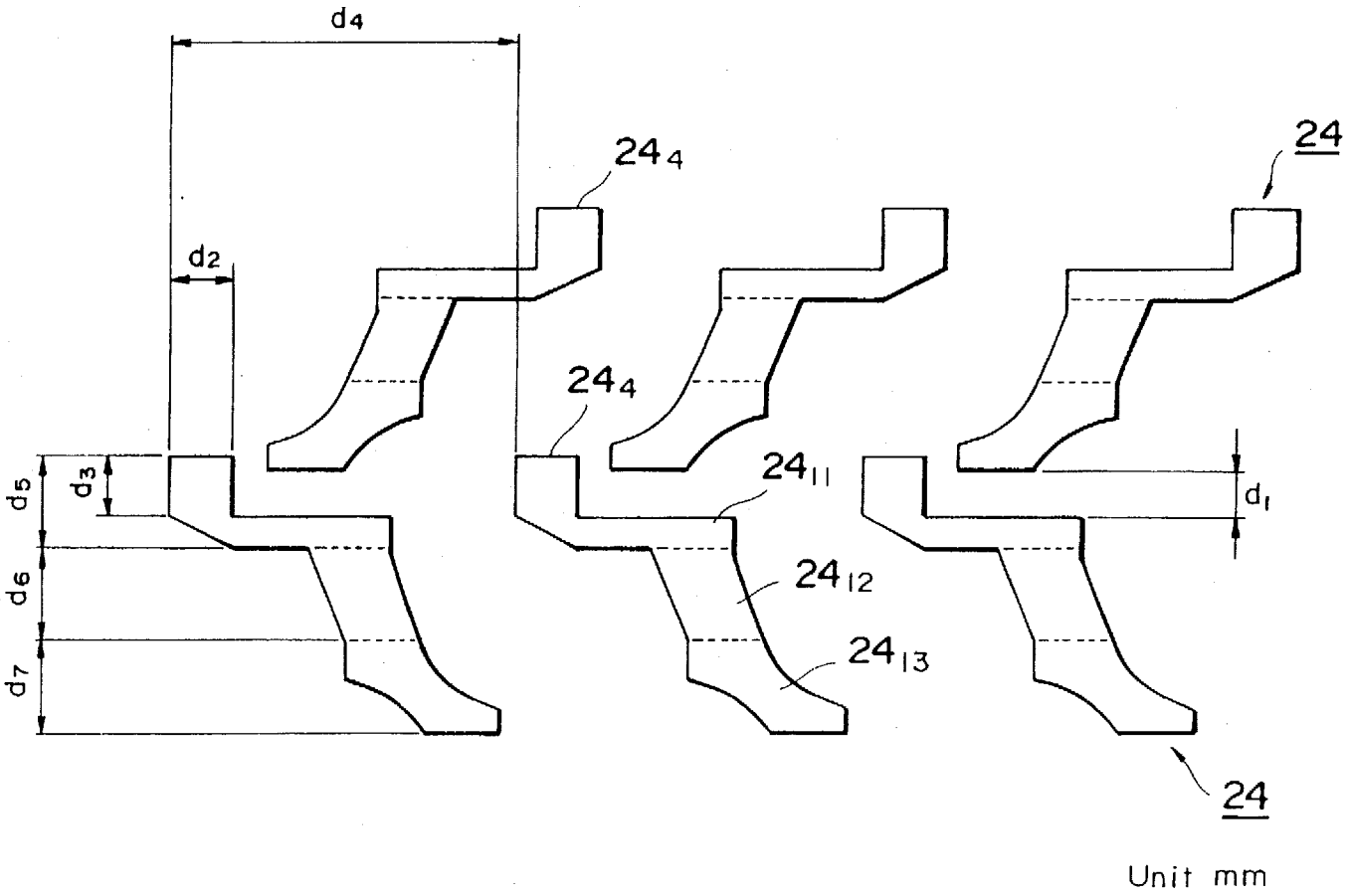
FIG. 6 is a view showing the size of each portion of the dynode.

FIG. 6 is a view showing the size of each portion of the nth dynode 24 and the (n+1)th dynode 24. Referring to FIG. 6, the nth dynode 24 and the (n+1)th dynode 24 are stacked at an interval $d_1$ of 0.09 mm. The acceleration electrode unit $24_4$ has a width $d_2$ of 0.12 mm and a thickness $d_3$ of 0.12 mm. An interval $d_4$ between the adjacent acceleration electrode units $24_4$ is 1.0 mm. The dynode 24 is constituted by three plates $24_{11}$ to $24_{13}$ bonded each other. The plates $24_{11}$ to $24_{13}$ have thicknesses $d_5$ of 0.18 mm, $d_6$ of 0.25 mm, and $d_7$ of 0.25 mm, respectively. As the interval $d_1$ between the nth dynode 24 and the (n+1)th dynode 24, the minimum value within a range not to cause discharge between the dynodes 24 is selected, which depends on the potential difference between the dynodes 24. Therefore, if the potential between the dynodes 24 is reduced, this interval can be smaller than 0.09 mm.

In the above-described embodiment, a photomultiplier has been exemplified as an electron tube having an electron multiplication unit. However, the present invention is not limited to the photomultiplier and may also be applied to an electron multiplier or image multiplier for amplifying the luminance of an input optical image as far as it is an electron tube having an electron multiplication unit for multiplying an incident electron flow by action of secondary electron emission.

In addition, in this embodiment, the area of the output opening is larger than that of the input opening, and the electron multiplication hole has a prismatic shape extending toward the output opening. However, the area of the input opening may be equal to that of the output opening such that the electron multiplication hole has a prismatic shape while the opposing surfaces are parallelly arranged. The shape of the electron multiplication hole is not limited to the prismatic shape and may also be a cylindrical shape. In this case, the input opening and the output opening are circular. The input opening and the output opening may have the same diameter. Alternatively, the output opening may have a larger diameter. The input opening and the output opening may have different shapes. For example, the input opening may be circular while the output opening is square.

Figure 7A:
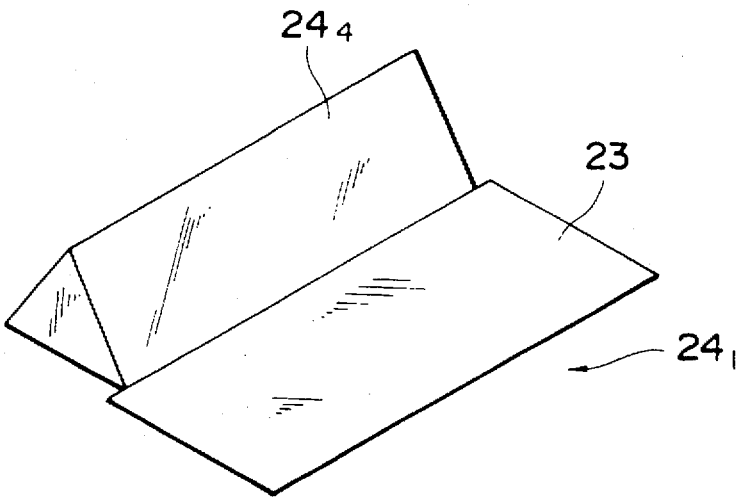
FIGS. 7A and 7B are perspective views showing other shapes of the acceleration electrode unit which may be provided on the dynode.
Figure 7B:
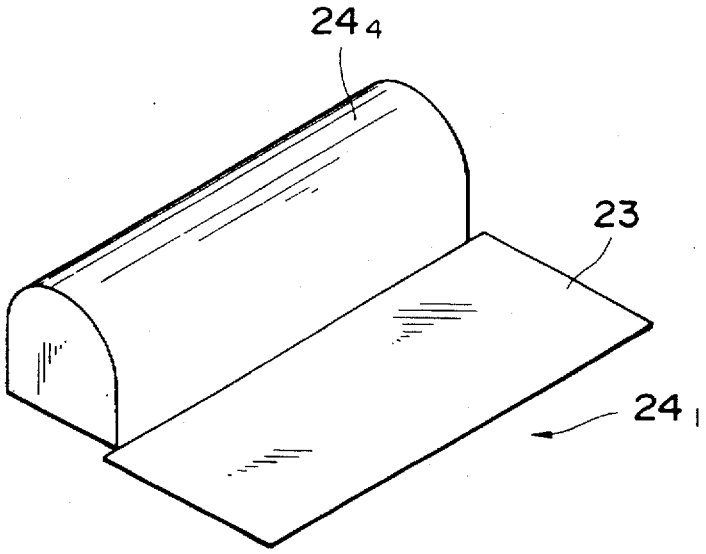

Furthermore, in this embodiment, the parallelepiped acceleration electrode unit is used. However, the acceleration electrode unit is not limited to the parallelepiped shape. As shown in FIG. 7A, it may be a column having a triangular section. Alternatively, it may be an inverted U-shaped column, as shown in FIG. 7B. In this embodiment, the acceleration electrode units enter the electrode multiplication holes of the upper stage. However, they do not necessarily enter the electron multiplication holes. It is sufficient that the acceleration electrode units project from the upper surface of the plate toward the electron multiplication holes of the upper stage. Even when the acceleration electrode units do not enter the electron multiplication holes of the upper stage, the damping electric field can be pushed up deeply into the electron multiplication holes.

The basic Japanese Application No.146639/1994 filed on Jun. 28, 1994 is hereby incorporated by reference.

What is claimed is:

1. An electron tube, comprising:

a first dynode plate for multiplying incident electrons having a first through hole, said first through hole having an incident opening for receiving the incident electrons and an emission opening for emitting multiplied electrons; and a second dynode plate for multiplying incident electrons positioned adjacent the first dynode plate and having a second through hole, said second through hole having an incident opening for receiving electrons emitted by the first dynode plate and an emission opening for emitting multiplied electrons;

wherein said second dynode plate has a protruding acceleration electrode unit disposed on a surface facing said first dynode plate, said protruding acceleration electrode unit being located close to the incident opening of the through hole of said second dynode plate and protruding towards said emission opening of said first dynode plate.

2. The electron tube according to claim 1, wherein said acceleration electrode unit of said second dynode plate protrudes into said through hole of said first dynode plate.

3. The electron tube according to claim 1, wherein said incident opening has a rectangular shape, said acceleration electrode unit has a parallelepiped shape, and a long side of said incident opening matches a longitudinal direction of said acceleration electrode unit.

4. The electron tube according to claim 1, wherein said acceleration electrode unit is formed as one of a column having a triangular cross section and a column having an inverted U-shaped cross section.

5. The electron tube according to claim 1, wherein said emission opening of each of said first and second through holes has a diameter larger than that of said incident opening.

6. The electron tube according to claim 5, wherein a central axis of at least one of said through holes is inclined by a predetermined angle with respect to a direction in which said first and said second dynodes are stacked.

7. The electron tube according to claim 6, further comprising a secondary electron radiation layer formed on a first inner wall as a part of an inner wall of at least one of said first and second through holes, the first inner wall facing said incident opening.

8. A electron tube according to claim 7, wherein a lower end portion of said first inner wall is a recessed curved surface.

9. A electron tube according to claim 1, wherein said electron tube is a photomultiplier for amplifying photoelectrons emitted upon reception of incident photons.

10. A electron tube according to claim 1, wherein said electron tube is an image multiplier for multiplying a luminance of an input optical image.

* * * * *